US005572297A

United States Patent [19]

Kawashima

[11] Patent Number: 5,572,297

[45] Date of Patent: Nov. 5, 1996

[54] DEVELOPER DISPERSING DEVICE

[75] Inventor: Takashi Kawashima, Kawasaki, Japan

[73] Assignee: Ricoh Company, Ltd., Tokyo, Japan

[21] Appl. No.: 363,879

[22] Filed: Dec. 27, 1994

[30] Foreign Application Priority Data

Dec. 27, 1993 [JP] Japan ..... 5-331417

[51] Int. Cl.[6] ..... G03G 15/06

[52] U.S. Cl. ..... 399/257; 118/653; 366/315; 366/316; 366/318

[58] Field of Search ..... 355/245, 246, 355/260, 251, 261, 259; 118/653, 651, 656–658, 661; 366/247, 279, 314–316, 318, 321, 322, 324

[56] References Cited

U.S. PATENT DOCUMENTS

| | | | |
|---|---|---|---|
| 4,583,842 | 4/1986 | Shimono et al. | 355/260 |
| 4,855,783 | 8/1989 | Takashima et al. | 355/245 X |
| 4,989,539 | 2/1991 | Ichikawa | 355/251 X |
| 5,016,053 | 5/1991 | Ibuchi et al. | 355/245 |
| 5,025,287 | 6/1991 | Hilbert | 355/245 |
| 5,189,474 | 2/1993 | Miya et al. | 355/245 |
| 5,220,382 | 6/1993 | Hediger | 355/245 |
| 5,260,033 | 11/1993 | Tarancon | 366/324 X |
| 5,345,298 | 9/1994 | Corrigan, Jr. | 355/260 |

*Primary Examiner*—Robert Beatty
*Attorney, Agent, or Firm*—Oblon, Spivak, McClelland, Maier & Neustadt, P.C.

[57] ABSTRACT

A developer dispersing device which can be utilized for moving dry two-component toner is applicable to electrophotographic apparatuses such as copiers, printers or facsimile machines. The developer dispersing device includes a rotatable shaft on which pumping plate members and blades are positioned so as to both laterally and radially move toner. The pumping plate member and blades are positioned on the shaft to permit an efficient lateral and radial displacement of the toner in combination with positively mixing newly supplied toner with stock toner so as to provide for an even image density.

10 Claims, 10 Drawing Sheets

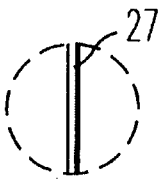
FIG. 11A
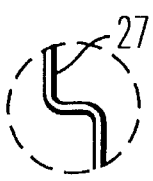
FIG. 11B
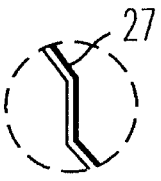
FIG. 11C
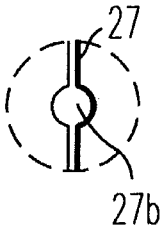
FIG. 11D
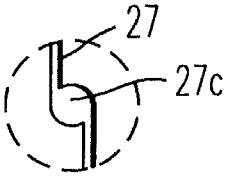
FIG. 11E
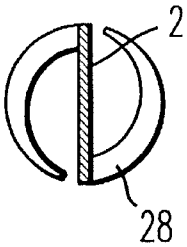
FIG. 12A
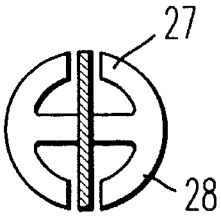
FIG. 12B
FIG. 12C

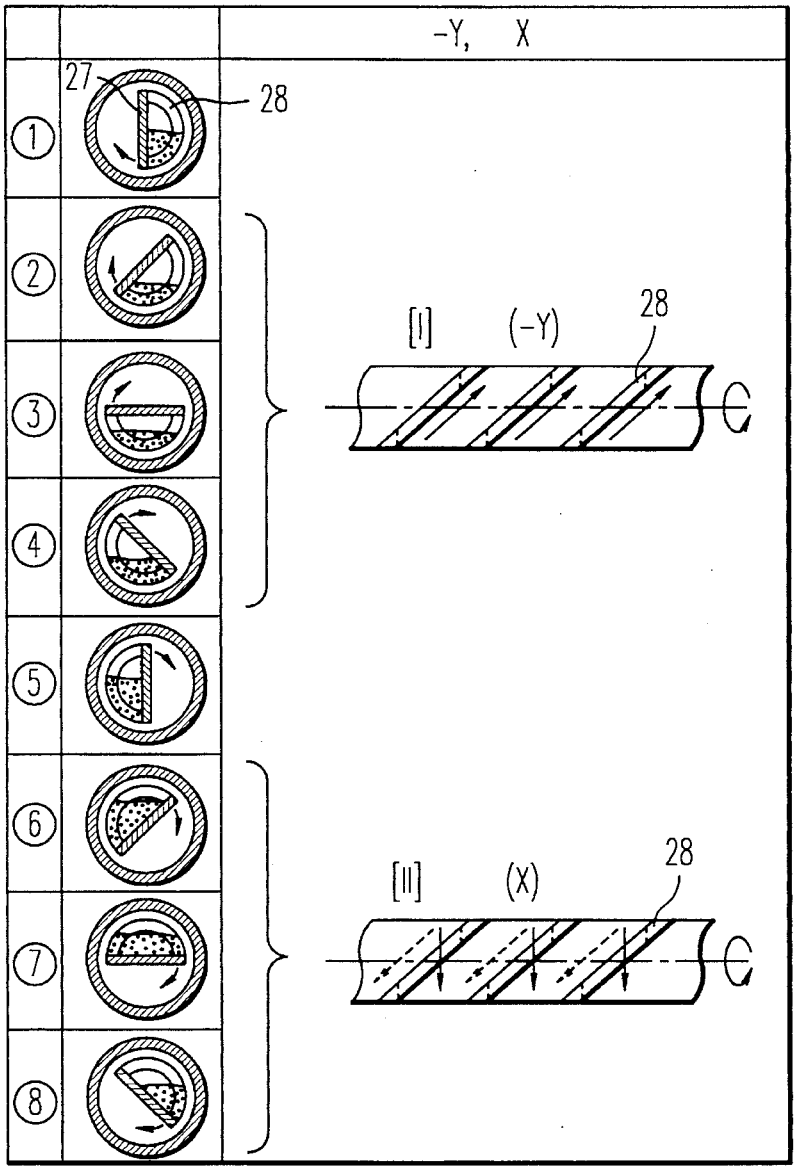
FIG. 13A
FIG. 13B
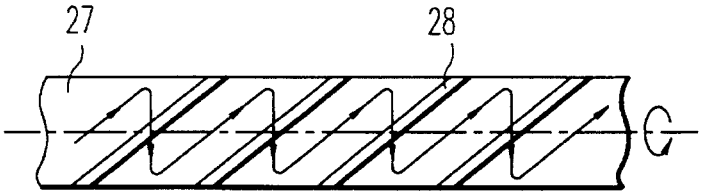
FIG. 14

DEVELOPER DISPERSING DEVICE

BACKGROUND OF THE INVENTION

1. Field of the Invention

The present invention relates to a developer dispersing device which can be used, for example, for dry two-component development. The invention is applicable to electrophotographic apparatuses, such as copiers, printers, facsimile machines, etc.

2. Discussion of the Background

A typical electrophotographic apparatus is illustrated in FIG. 20 and comprises a photoconductive drum 2 as a charge receiving member and a charging device 1. The photoconductive drum 2 rotates at a predetermined speed in the direction indicated by the arrow sequentially in relation to a plurality of processing stations disposed about its rotational path of movement. As illustrated in FIG. 20, the charging device 1 initially contacts the surface of the photoconductive drum 2 at a predetermined pressure and charges the photoconductive drum 2 to a substantially uniform potential, either positive or negative. Downstream at exposure device 3, light rays reflected from an original document are reflected through a lens and projected onto a charge portion of the surface of the photoconductive drum 2 to selectively dissipate the charge thereon. Such selective charge dissipation records an electrostatic latent image on a circumference of the photoconductive drum 2 corresponding to the informational area contained within an original document.

Thereafter, the photoconductive drum 2 rotates downstream to a developing device 4 where a developer mix (for example carrier particles and toner) are passed into contact with the latent electrostatic image. The toner particles are attracted away from the carrier beads by the latent electrostatic image to thereby form toner powder images on the surface of the photoconductive drum 2. The development station may apply one or more or colors of developer material.

Also illustrated in FIG. 20 is a paper copy sheet 5 which is advanced into contact with the development latent image at a transfer device 6. The toner powder image is thereafter transferred from the photoconductive drum 2 to the paper 5. After transfer, the toner image is fixed on paper 5 by a fixing device 7, and photoconductive drum 2 is discharged by a discharger device 9. Residual toner on the photoconductive 2 is removed by a cleaning device 8.

FIG. 21 illustrates in detail the development device 4. In FIG. 21, a toner hopper 10, a dispersing roller 11 and a developing sleeve 12 are illustrated. Toner is supplied into the toner hopper 10 by rotation of a toner supply device 15. This supplies toner onto the dispersing roller 11 which supplies toner to the developing sleeve 12. FIG. 21 also illustrates a doctor blade 13 for controlling the quantity of toner on the developing sleeve 12 as well as a developing area 14.

In conventional arrangements, a lateral difference of toner density in the dispersing roller 11 causes an unevenness of image density on a copied paper. When an original document comprises a lateral difference of image ratio or information ratio and the original document is copied a plurality of times, some parts which have a high image ratio or a high information ratio consume a lot of toner, and this causes the toner density of these parts to become extremely lower than the toner density of the other parts.

Accordingly, dispersing rollers not only have to have the function of mixing newly supplied toner with stock toner, but also have to have the function of pumping up the toner and also laterally or longitudinally dispersing toner. If a dispersing roller does not correctly longitudinally or laterally disperse toner, the toner supplied to the dispersing roller will form a lump or the like. This will cause an unevenness of image density. Accordingly, a dispersing roller which not only longitudinally disperses toner, but also shakes and mixes the toner, is necessary.

An example of a conventional screw-type dispersing roller is illustrated in Japanese Document 55-6997. Although the dispersing roller in Japanese Document 59-6997 achieves a lateral transfer of toner, the mechanism is expensive and requires a maximum amount of space. Additionally, it does not achieve the desired amount of radial and lateral toner movement which is necessary to achieve an even image density.

FIGS. 22 and 23 of the present application also illustrate conventional dispersing devices in the form of dispersing plates or wings. Both types of toner dispersing devices illustrated in FIGS. 22 and 23 can achieve some form of lateral toner transfer between cells 160, however, utilization of only the plates 170 cannot assure a positive transfer of toner between cells. In the toner transfer devices illustrated in FIGS. 22 and 23, toner is transferred from one cell to another via a gap between the plates and the hopper. If the plates 170 are large, toner transfer between cells is difficult, while if the plates are small, the mixture of toner is not sufficient. Also, these types of devices do not provide the desired combination of radial and lateral transfer of toner.

Finally, Japanese documents 64-24282 and 3-105370, which also disclose conventional toner dispersing devices, illustrate devices which are not capable of achieving a sufficient lateral transfer of toner in combination with a radial movement of toner for achieving an even image density.

SUMMARY OF THE INVENTION

Accordingly, an object of the present invention is to provide for a developer dispersing device which can be used in a development apparatus and can efficiently mix toner, can laterally or longitudinally transfer the toner, and at the same time can achieve a desired amount of radial movement of the toner. The developer dispersing device of the present invention can therefore achieve a highly efficient mixture of a dry two-component toner in the form of a toner and carrier.

The developer dispersing device of the present invention comprises a rotatable shaft having first and second ends for mounting in a development apparatus housing; a plurality of spaced plate members longitudinally mounted along a length of the rotatable shaft, each of the plate members radially extending from the rotatable shaft and being inclined with respect to a rotational axis of the shaft for longitudinally moving a toner along the length of the shaft upon rotation of the shaft; and an inclined pumping plate attached to the shaft and longitudinally extending along the length of the shaft. The pumping plate and adjacently positioned plate members form cells for the toner along the length of the rotatable shaft. The pumping plate has a longitudinal axis which intersects the rotational axis of the shaft, such that a first end portion of the pumping plate is positioned on one side of the rotational axis of the shaft at the first end of the shaft, and a second end portion of the pumping plate is positioned on a second opposite side of the rotational axis of the shaft at the second end of the shaft. The pumping plate radially and longitudinally moves the toner with respect to the shaft upon rotation of the shaft.

The present invention also relates to a developer dispersing device in which a plurality of inclined pumping plates can be positioned within each cell defined by adjacently positioned plate members and each of the plate members extend at an incline with respect to the rotational axis of the shaft between the adjacently positioned plate members. The plurality of inclined pumping plates radially and longitudinally move the toner upon a rotation of the shaft.

The present invention also relates to a developer dispersing device in which a plurality of spaced radial blade means are longitudinally mounted on and extend along a length of a shaft. Each of the radial blade means comprise first and second opposing members which face each other with the shaft centrally extending therebetween. Each of the first and second opposing members comprise an end portion with an edge that is substantially perpendicular to a longitudinal axis of the shaft.

The present invention also relates to a developer dispersing device in which a rotatable pumping plate has first and second ends for permitting the pumping plate to be mounted in a development apparatus housing. The device also includes a plurality of circular dispersing wings mounted on the rotatable pumping plate at an angle with respect to an axis of rotation of the pumping plate for laterally moving toner along a length of the rotatable pumping plate.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 11(*a*), 11(*b*), 11(*c*), 11(*d*) and 11(*e*) are views of different embodiments of the pumping plate illustrated in FIG. 10;

FIGS. 12(*a*), 12(*b*) and 12(*c*) are views of different embodiments of the combination of the pumping plate and dispersing wings illustrated in FIG. 10;

FIGS. 13(*a*) and 13(*b*) illustrate toner movement utilizing the developer dispersing device of FIG. 10;

FIG. 14 illustrates a toner movement in the embodiment of FIG. 10;

DESCRIPTION OF THE PREFERRED EMBODIMENTS

Figure 1:
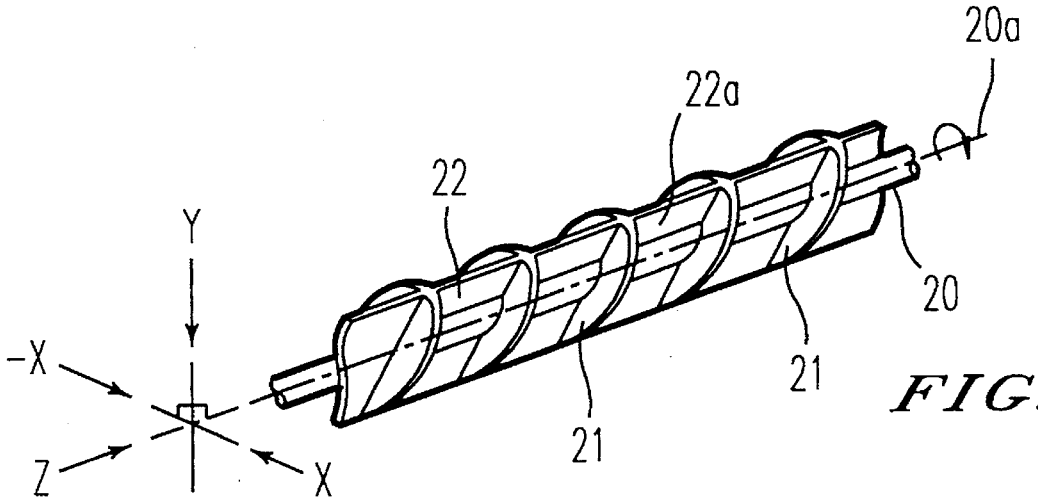
FIG. 1 illustrates a first embodiment of the developer dispersing device of the present invention.
Figure 3A:
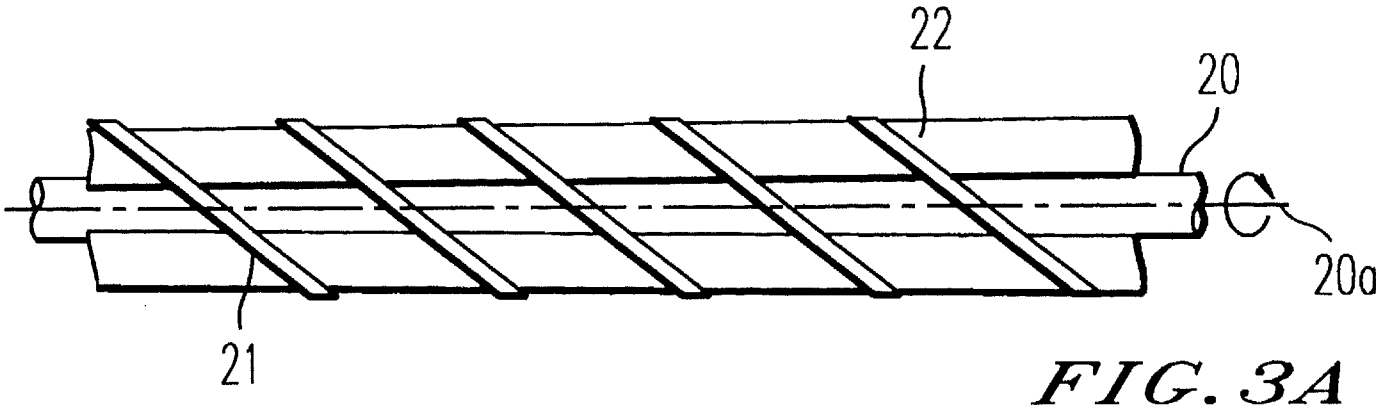
FIGS. 3(*a*) and 3(*b*) are further views of the developer dispersing device of FIG. 2.
Figure 3B:
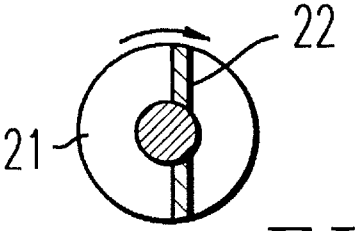

Referring now to the drawings, wherein like reference numerals designate identical or corresponding parts throughout the several views, and more particularly to FIG. 1 thereof, FIG. 1 illustrate a first embodiment of the developer dispersing device of the present invention. In FIG. 1, a rotatable shaft 20 which can be rotated by any well known rotational device is illustrated. Mounted on the rotatable shaft 20 are a plurality of elliptically-shaped plates 21 which as illustrated in FIG. 3(*a*) can be positioned at an angle with respect to the rotational axis 20*a* of the shaft 20. The plates 21 can define a helical configuration on the shaft 20 to promote mixture and movement of toner along the shaft 20. Also mounted on the shaft 20 is a pumping plate 22 as further illustrated in FIG. 1. The combination of the pumping plate 22 and adjacently positioned elliptical plates 21 form cells 22*a* for receiving toner such as two-component toner.

Figure 2:
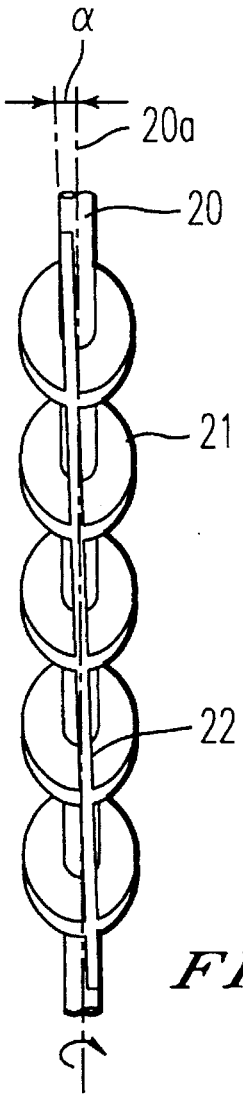
FIG. 2 is a further view of the developer dispersing device of FIG. 1.

As illustrated in FIG. 2, one end of the pumping plate 22 is positioned at one end of the shaft 20 at an angle $\alpha$ with respect to the rotational axis 20*a* of the shaft 20. Therefore, the longitudinal axis of the plate 22 intersects the rotational axis 20*a* of the shaft 20, such that at one end of the shaft 20 the pumping plate 22 is positioned on one side of the rotational axis 20*a*, while at the other end of the shaft 20, the pumping plate 22 is positioned on an opposite side of the rotational axis 20*a* of the shaft 20.

The larger the angle $\alpha$ illustrated in FIG. 2, the more efficient operation will be achieved by the developer dispersing device of FIG. 2.

FIG. 3(*a*) shows that the plate 22 can have a slight taper from one end of the shaft 20 to the other end of the shaft 20 to also achieve a better combination of lateral and radial movement of toner. FIG. 3(*b*) illustrates a side view of the developer dispersing arrangement of FIG. 3(*a*).

Figures 4A, 4B, 4C, 4D:
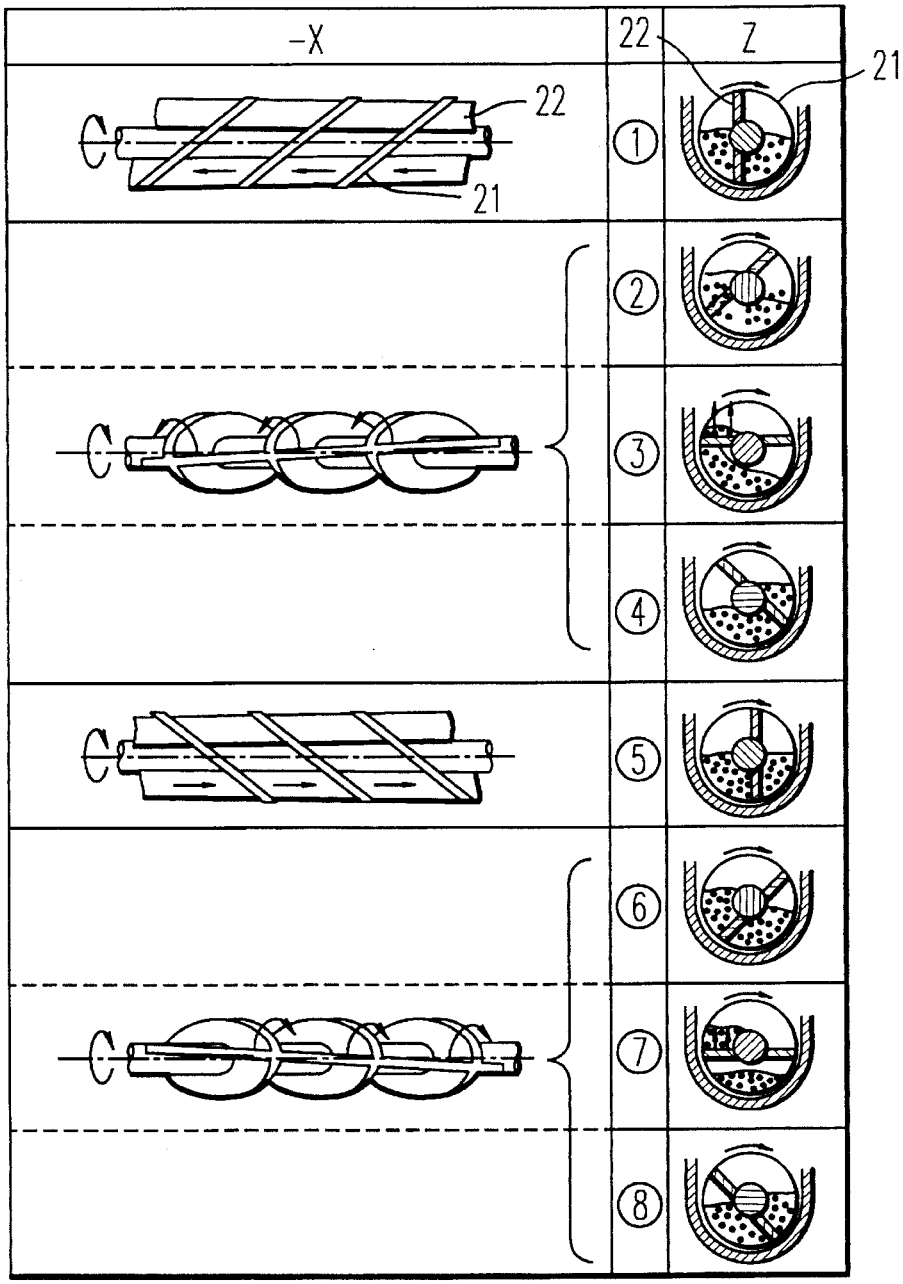
FIGS. 4(*a*), 4(*b*), 4(*c*) and 4(*d*) illustrate a toner movement utilizing the developer dispersing device of FIG. 1.

FIGS. 4(*a*)–4(*b*) sequentially show the movement of toner utilizing the developer dispersing device of FIG. 1. As set forth above, the developer dispersing device of the present invention is particularly applicable to two-component toner. As illustrated by ①–②–③, upon rotation of the shaft 20, the plate 22 radially pumps up toner and at the same time, the elliptical plates 21 laterally push the toner in a direction of the arrows. It is noted that the toner is also laterally or longitudinally transferred by the inclination of the plate 22 in a direction of the arrows.

As illustrated by ④–⑤ the toner still is transferred by the inclined plate 22 in the direction of the arrows. ⑤–⑧ illustrate the reverse movement of ①–④ on the opposite side of the developer dispersing device.

Therefore, due to the elliptical and helical nature of the elliptical plates 21, and the inclined configuration of the pumping plate 22, toner is mixed, radially displaced, and is also laterally displaced by not only the elliptical plates 21, but also the inclined plate 22. This achieves an efficient and even transfer and mixture of toner and provides for an even image density. This also permits newly supplied toner to be positively mixed with stock toner.

Figure 5:
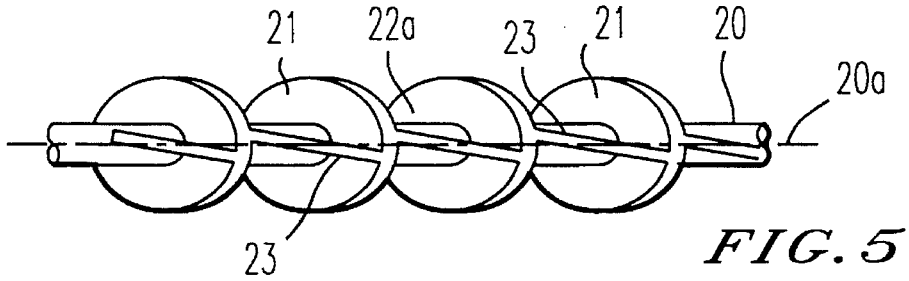
FIG. 5 illustrates a second embodiment of the developer dispersing device of the present invention.

FIG. 5 shows a second embodiment of the developer dispersing device of the present invention. In FIG. 5, the elliptical pumping plates 21 are similar to that illustrated in FIG. 1. However, in FIG. 5, a plurality of separate inclined pumping plates 23 are disclosed. As illustrated in FIG. 5, each of the inclined pumping plates 23 are disposed at an angle with respect to the rotational axis 20*a* of the shaft 20, and are separately positioned within each respective cell 22*a* defined by the elliptical plates 21. As further illustrated in FIG. 5, each pumping plate 23 includes a first end portion positioned on one side of the axis 20*a* and a second end portion positioned on a second opposite side of the axis 20*a*. The larger the inclination of the pumping plates 23, the better lateral shaking and dispersing of toner will be achieved. Thus, an efficient developer dispersing device which achieves a maximum lateral and radial displacement and mixture of toner can be realized. Additionally, each plate 23 can have a different inclination depending on the desired mixture of toner and size of paper.

Figure 6A:
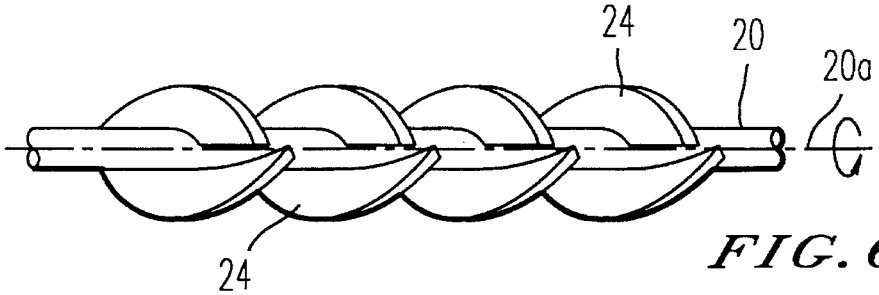
FIGS. 6(*a*) and 6(*b*) illustrate a third embodiment of the developer dispersing device of the present invention.
Figure 6B:
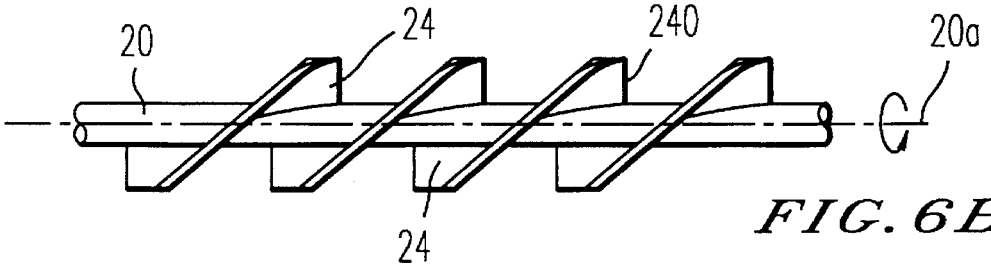

FIGS. 6(*a*) and 6(*b*) illustrate a third embodiment of the developer dispersing device of the present invention. FIG. 6(*a*) is a top view while FIG. 6(*b*) is a side view. As illustrated in FIG. 6(*a*), plates in the form of twisted portions 24 are illustrated and as shown in FIG. 6(*b*), can be in the form of two half-screws so as to achieve a desired transfer in two directions. As shown in FIG. 6(*a*), the end portion of the plates 24 run parallel to the rotational axis 20*a* of the shaft 20, and as illustrated in FIG. 6(*b*), the end portions also include flat portions having an edge 240 which is substantially perpendicular to the rotational axis 20*a* of the shaft 20. This arrangement permits the desired amount of shaking force and lateral transportation which can achieve an even image density. Additionally, this specific arrangement permits an efficient radial and lateral movement of the toner.

Figure 7A:
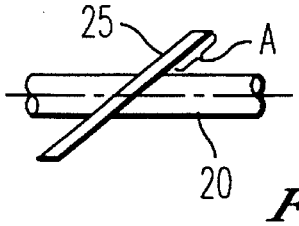
FIGS. 7(*a*) and 7(*b*) are views of a blade and shaft arrangement of the developer dispersing device.
Figure 7B:
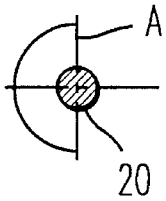
Figure 8A:
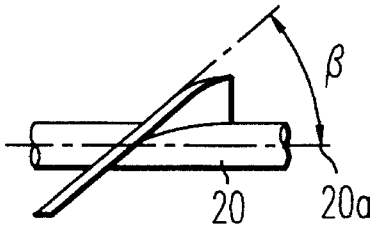
FIGS. 8(*a*) and 8(*b*) are further views of a blade and shaft arrangement of the developer dispersing device.
Figure 8B:
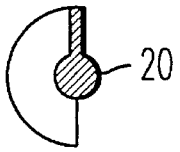

FIGS. 7(*a*), 7(*b*), 8(*a*) and 8(*b*) illustrate the relationship between the plates and the rotational axis of the shaft. As illustrated in FIGS. 7(*a*) and 7(*b*), the portion marked by A can be twisted to achieve the configuration of FIGS. 6(*a*) and 6(*b*). As illustrated in FIGS. 8(*a*) and 8(*b*), an inclined angle β of the elliptical plate can be changed so as to control the amount of toner which is transferred between cells.

Figure 9:
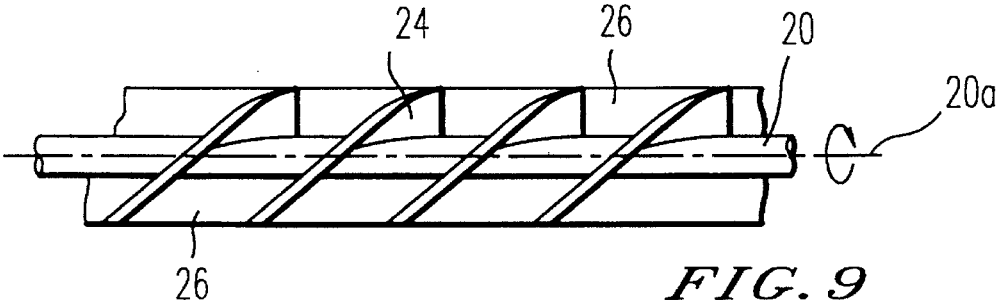
FIG. 9 is a fourth embodiment of the developer dispersing device of the present invention.

FIG. 9 illustrates a fourth embodiment of the developer dispersing device of the present invention. FIG. 9 is similar to the embodiment of FIGS. 6(*a*) and 6(*b*) but includes an additional plate 26 which is parallel to the rotational axis 20*a* of the shaft 20. The additional plate 26 has the effect of increasing the dispersal force upon rotation of the shaft 20 so as to achieve an efficient lateral and radial movement of the toner in combination with a mixture of the toner.

Figure 10:
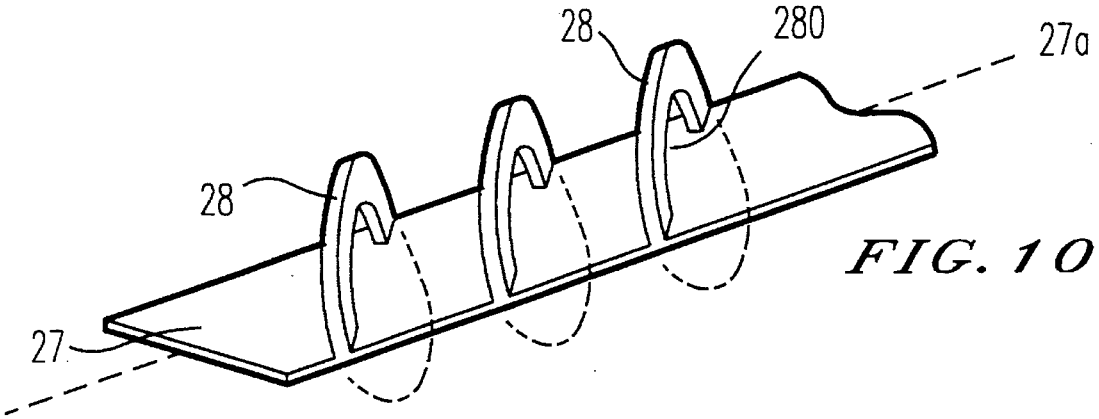
FIG. 10 is a fifth embodiment of the developer dispersing device of the present invention.

FIG. 10 illustrates a fifth embodiment of the developer dispersing device of the present invention. In FIG. 10, a pumping plate shaft is illustrated by the reference numeral 27. The pumping plate shaft 27 is rotatable about the rotational axis 27*a*. Circular dispersing wings 28 are mounted on the pumping plate 27. Dispersing wings 28 include openings 280 for permitting movement of toner. For purposes of illustration, FIG. 10 only shows the top half of the dispersing wings 28 and pumping plate shaft 27.

FIGS. 11(*a*)–11(*e*) show different possible configurations of the pumping plate shaft 27. The pumping plate shaft 27 can also have a reinforcing portion 27*b*, 27*c* as illustrated in FIGS. 11(*d*) and 11(*e*).

FIGS. 12(*a*)–12(*c*) illustrate possible configurations for the dispersing wings 28.

FIGS. 13(*a*) and 13(*b*) illustrate movement of toner upon the rotation of the pumping plate shaft 27 of the developer dispersing device illustrated in FIG. 10. Numbers ①–②–③–④ show the lateral transfer of the toner along the wings 28.

Numbers ④–⑤–⑥–⑦–⑧ also show the lateral transfer of the toner along the wings 28 upon further rotation of the pumping plate shaft 27. As illustrated in FIG. 13(*b*), if the wings 28 have no opening, the toner will move along the wings 28 as shown by the dotted line in FIG. 13(*b*). If there is an opening in the wings 28, the toner can move from one cell to the other as illustrated by the arrow in FIG. 14. The opposite side of the developer dispersing device illustrated in FIG. 14 will achieve a toner movement in the opposite direction than the direction illustrated in FIG. 14. It is further noted that a transfer can be achieved due to an opening between a case in which the developer dispersing device is rotatably mounted and the pumping plate shaft 27.

Figure 15:
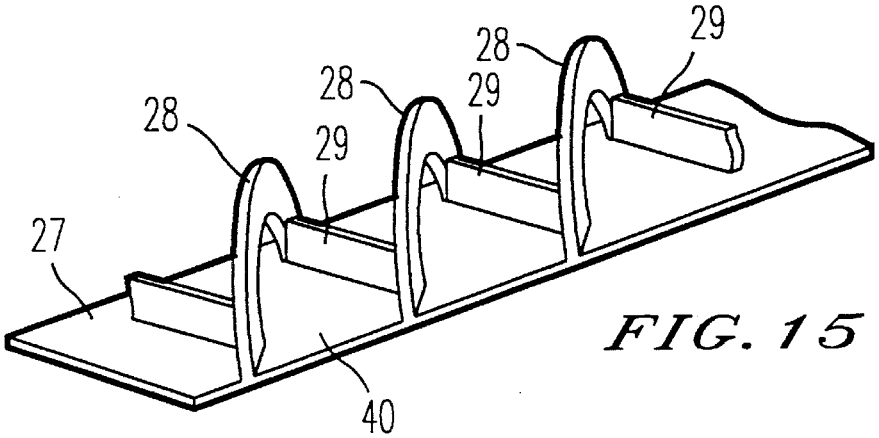
FIG. 15 is a sixth embodiment of the developer dispersing device of the present invention.

FIG. 15 shows a sixth embodiment of the developer dispersing device of the present invention. FIG. 15 is similar to the embodiment of FIG. 10 but includes ribs 29. In order to more clearly understand the invention, FIG. 15 only shows one-half of the dispersing wings 28. The ribs 29 are capable of more positively guiding toner between the cells 40 upon rotation of the plate 27.

Figure 16A:
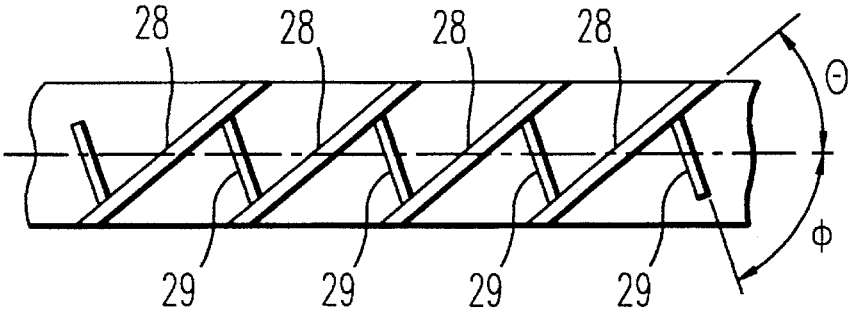
FIGS. 16(*a*) and 16(*b*) are views of the developer dispersing device of FIG. 15.
Figure 16B:
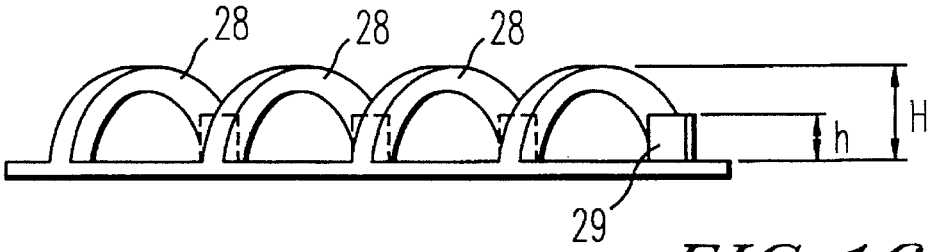

As illustrated in FIG. 16(*a*), when an angle θ is defined as:

$$0°<\theta<90°,$$

the angle ϕ should be $-90° \leqq \phi < 0$. This range of the angle ϕ provides for good toner movement.

Additionally, as illustrated in FIG. 16(*b*), if h is equal to the height of the rib 29 with respect to the pumping plate shaft 27, while H is equal to the height of a dispersing wing 28 with respect to the plate 27, then $h \leqq H/2$. If h is greater than H/2, then a lateral toner movement will be inhibited.

Figure 17:
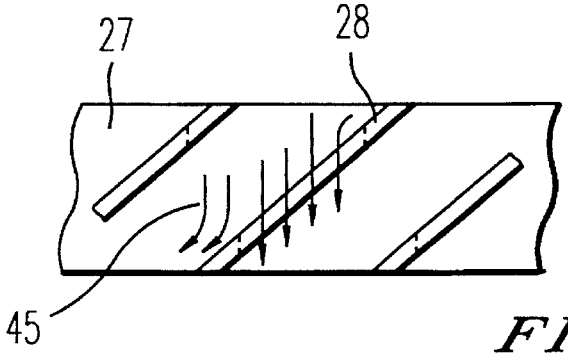
FIG. 17 illustrates a toner movement in the developer dispersing device of, for example, FIG. 10.
Figure 18:
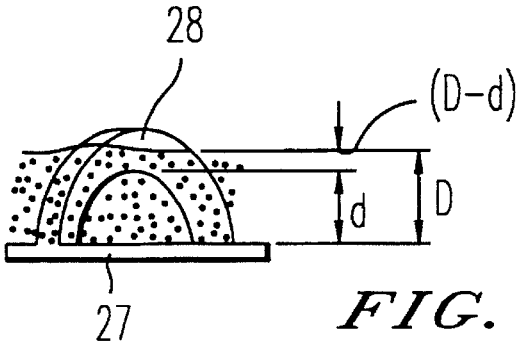
FIG. 18 is an isolated view of the dispersing wing of the developer dispersing device.

FIG. 17 show a toner movement of toner utilizing the embodiment of FIG. 10. Toner movement of toner illustrated by the arrow 45 in FIG. 17 cannot be transferred to the next cell. As illustrated in FIG. 18, if D is the height of the toner, and d is the height of the opening of the wing 28, then the toner defined by (D-d) cannot be transferred to the next cell. This is illustrated by the arrow 45 in FIG. 17.

Figure 19:
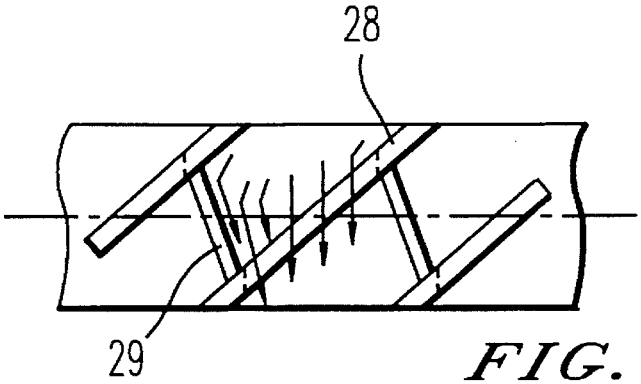
FIG. 19 is a view of a toner movement in the developer dispersing device of FIG. 15.
Figure 20:
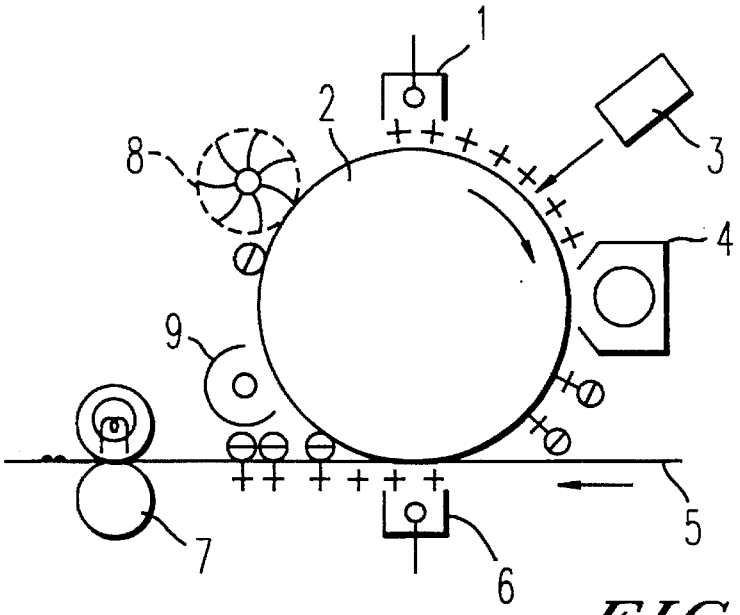
FIG. 20 PRIOR ART
FIG. 20 is a schematic illustration of an electrophotographic apparatus.
Figure 21:
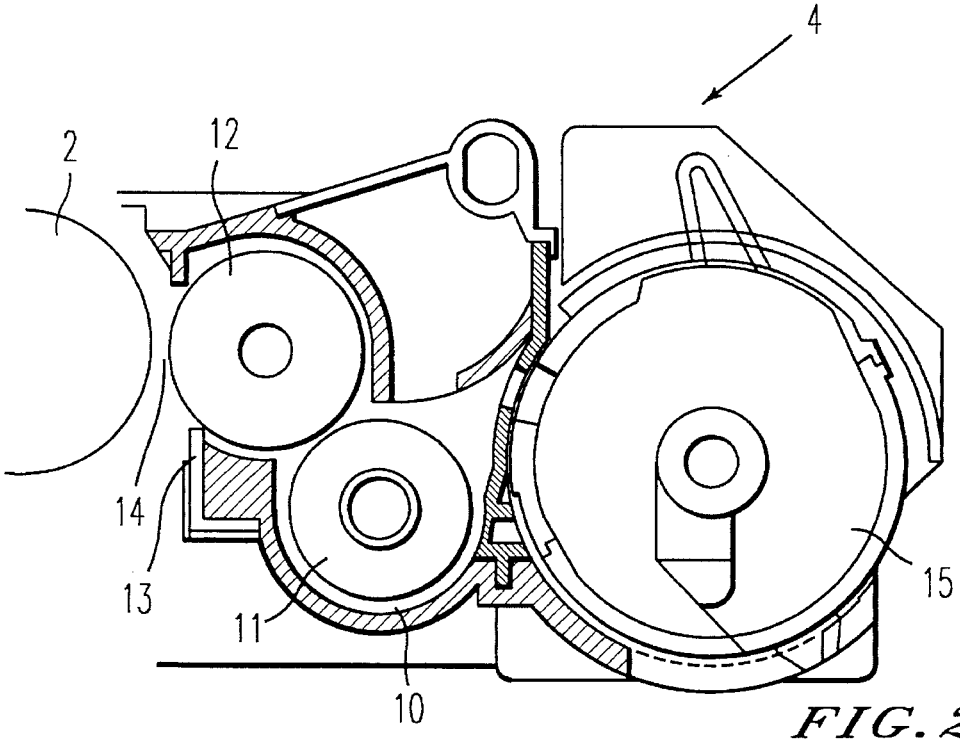
FIG. 21 PRIOR ART
FIG. 21 shows a toner hopper, dispersing roller and developing sleeve arrangement.
Figure 22:
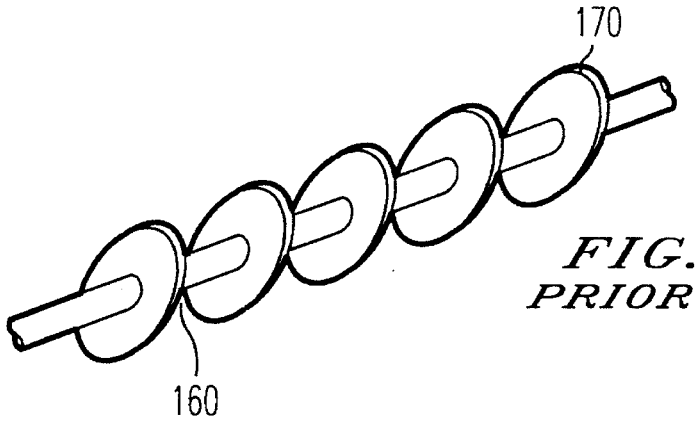
FIG. 22 PRIOR ART
FIG. 22 shows a conventional developer dispersing device.
Figure 23:
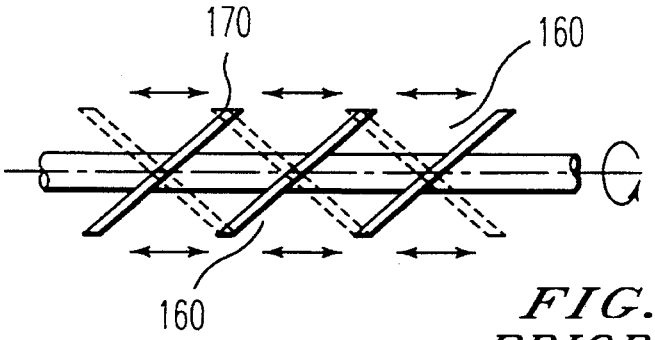
FIG. 23 PRIOR ART
FIG. 23 shows a conventional developer dispersing device.

By utilizing the ribs 29 as illustrated in FIG. 19, toner movement can be guided by the ribs 29 towards the next cell so as to more positively promote a lateral toner transfer. Accordingly, the utilization of the ribs provides for an efficient positive toner transfer.

Obviously, numerous additional modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A developer dispersing device for use in a development apparatus, the developer dispersing device comprising:

a rotatable shaft having first and second ends for mounting in a development apparatus housing;

a plurality of spaced plate members longitudinally mounted along a length of the rotatable shaft, each of the plate members radially extending from said rotatable shaft and being inclined with respect to a rotational axis of said shaft for longitudinally moving a toner along the length of said shaft upon rotation of said shaft; and an inclined pumping plate attached to the shaft and longitudinally extending along the length of the shaft, wherein said pumping plate and adjacently positioned plate members form cells for the toner along the length of the rotatable shaft, said pumping plate having a longitudinal axis which intersects the rotational axis of said shaft, such that a first end portion of said pumping plate is positioned on one side of the rotational axis of the shaft at the first end of shaft, and a second end portion of said pumping plate is positioned on a second opposite side of the rotational axis of said shaft at the second end of said shaft, wherein said pumping plate radially and longitudinally moves the toner with respect to said shaft upon rotation of said shaft.

2. A developer dispersing device according to claim 1, wherein a width of the pumping plate tapers from the first end of the shaft to the second end of the shaft.

3. A developer dispersing device according to claim 1, wherein said plurality of spaced plate members are elliptically shaped.

4. A developer dispersing device for use in a development apparatus, the developer dispersing device comprising:

a rotatable shaft having first and second ends for mounting in a development apparatus housing;

a plurality of spaced plate members longitudinally mounted along a length of said shaft, each of said plate members radially extending from said shaft and circumferentially surrounding said shaft, each of said plate members being positioned so as to longitudinally move a toner along the length of the said shaft upon rotation of said shaft, wherein a cell for the toner is defined between adjacently positioned plate members; and a plurality of inclined pumping plates positioned within each cell defined by said adjacently positioned plate members so as to extend from one of said plate members to an adjacent plate member, each of said pumping plates extending at an incline with respect to a rotational axis of said shaft between the adjacently positioned plate members, such that a first end portion of each of said inclined pumping plates is positioned on a first side of the rotational axis of said shaft, and a second end portion of each of said inclined pumping plates is positioned on a second opposite side of the rotational axis of said shaft, wherein said plurality of inclined pumping plates radially and longitudinally move the toner upon a rotation of said shaft.

5. A developer dispersing device according to claim 4, wherein said pumping plates are elliptically shaped.

6. A developer dispersing device for use in a development apparatus, the developer dispersing device comprising:

a rotatable shaft having first and second ends for mounting in a development apparatus housing; and a plurality of spaced radial blade means longitudinally mounted and extending along a length of said shaft, each of said radial blade means comprising first and second opposing members which face each other and define two half-screws with said shaft centrally extending therebetween, each of said first and second opposing members comprising an end portion with an edge that is substantially perpendicular to a longitudinal axis of said shaft.

7. A developer dispersing device for use in a development apparatus, the developer dispersing device comprising:

an agitating means including:

a rotatable pumping plate shaft having first and second ends for mounting in a development apparatus housing; and a plurality of circular dispersing wings mounted on said rotatable pumping plate shaft at an angle with respect to an axis of rotation of said pumping plate shaft for moving toner along a length of said rotatable pumping plate shaft, wherein an opening is defined between each of said dispersing wings and said rotatable pumping plate shaft for toner passage therebetween, and a rotation of said agitating means in one direction causes a toner movement along the length of said rotating pumping plate shaft in opposite directions.

8. A developer dispersing device according to claim 7, further comprising lateral ribs mounted on said pumping plate shaft between said circular dispersing wings for guiding toner through the openings of the circular dispersing wings to a next cell defined by an adjacent circular dispersing wing.

9. A developer dispersing device according to claim 8, wherein an angle between said rib and a rotational axis of said pumping plate shaft is greater than 0° and less than or equal to 90°.

10. A developer dispersing device according to claim 8, wherein a height of said rib as said rib extends from a surface of said pumping plate shaft is h, and a height of said circular dispersing wing as said wing extends from said surface of said pumping plate shaft is H, such that $h \leqq H/2$.

* * * * *